US008947020B1

(12) United States Patent
Xiong

(10) Patent No.: US 8,947,020 B1
(45) Date of Patent: Feb. 3, 2015

(54) END OF LIFE CONTROL FOR PARALLEL LAMP BALLAST

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 262 days.

(21) Appl. No.: 13/478,583

(22) Filed: May 23, 2012

Related U.S. Application Data

(60) Provisional application No. 61/561,054, filed on Nov. 17, 2011.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/308; 315/291; 315/297; 315/307

(58) Field of Classification Search
CPC ..... H05B 41/24; H05B 41/16; H05B 37/00
USPC ..... 315/124, 291, 294, 297, 307, 308, 149, 315/151
See application file for complete search history.

(56) References Cited

U.S. PATENT DOCUMENTS

| | | | |
|---|---|---|---|
| 3,562,580 | A | 2/1971 | Blomgren et al. |
| 3,577,173 | A | 5/1971 | Blomgren |
| 3,671,955 | A | 6/1972 | Malekzadeh |
| 3,995,262 | A | 11/1976 | France et al. |
| 4,039,895 | A | 8/1977 | Chermin et al. |
| 4,222,047 | A | 9/1980 | Finnegan |
| 4,249,111 | A | 2/1981 | Gluck |
| 4,382,212 | A | 5/1983 | Bay |
| 4,429,356 | A | 1/1984 | Inui et al. |
| 4,488,199 | A | 12/1984 | Bloomer |
| 4,501,992 | A | 2/1985 | Evans et al. |
| 4,555,587 | A | 11/1985 | Argentieri |
| 4,667,131 | A | 5/1987 | Nilssen |
| 4,810,936 | A | 3/1989 | Nuckolls et al. |
| RE32,901 | E | 4/1989 | Nilssen |
| RE32,953 | E | 6/1989 | Nilssen |
| 5,023,516 | A | 6/1991 | Ito et al. |
| 5,055,747 | A | 10/1991 | Johns |

(Continued)

FOREIGN PATENT DOCUMENTS

| | | |
|---|---|---|
| CA | 1013840 | 7/1977 |
| JP | 1149398 | 6/1989 |

(Continued)

*Primary Examiner* — Anh Tran
(74) *Attorney, Agent, or Firm* — Waddey Patterson; Mark J. Patterson; Mark A. Pitchford

(57) ABSTRACT

A light fixture includes a ballast and a plurality of lamps connected to the ballast in parallel. The ballast provides an output signal to the plurality of lamps as a function of a 1st steady state condition. When the ballast senses an end-of-life condition for a lamp of the plurality of lamps, the ballast increases the frequency of the output signal provided to the plurality of lamps until the lamp ceases to conduct current. When the lamp ceases to conduct current, the ballast decreases the frequency of the output signal to a frequency determined as a function of a 2nd steady state condition different from the 1st steady state condition. A total current of the 2nd steady state condition is proportional to a total current of the 1st steady state condition as a function of the number of lamps exhibiting an end-of-life condition.

28 Claims, 6 Drawing Sheets

(56) References Cited

U.S. PATENT DOCUMENTS

| | | | | |
|---|---|---|---|---|
| 5,068,570 | A | 11/1991 | Oda et al. | |
| 5,089,753 | A | 2/1992 | Mattas | |
| 5,111,114 | A | 5/1992 | Wang | |
| 5,138,235 | A | 8/1992 | Sun et al. | |
| 5,142,202 | A | 8/1992 | Sun et al. | |
| 5,220,247 | A | 6/1993 | Moisin | |
| 5,262,699 | A | 11/1993 | Sun et al. | |
| 5,293,099 | A | 3/1994 | Bobel | |
| 5,321,337 | A | 6/1994 | Hsu | |
| 5,332,951 | A | 7/1994 | Turner et al. | |
| 5,387,846 | A | 2/1995 | So | |
| 5,436,529 | A | 7/1995 | Bobel | |
| 5,475,284 | A | 12/1995 | Lester et al. | |
| 5,493,180 | A | 2/1996 | Bezdon et al. | |
| 5,500,576 | A | 3/1996 | Russell et al. | |
| 5,574,335 | A | 11/1996 | Sun | |
| 5,606,224 | A | 2/1997 | Hua | |
| 5,619,105 | A | 4/1997 | Holmquest | |
| 5,635,799 | A | 6/1997 | Hesterman | |
| 5,636,111 | A | 6/1997 | Griffin et al. | |
| 5,650,694 | A | 7/1997 | Jayaraman et al. | |
| 5,705,894 | A | 1/1998 | Krummel | |
| 5,717,295 | A | 2/1998 | Nerone | |
| 5,729,096 | A | 3/1998 | Liu et al. | |
| 5,739,645 | A | 4/1998 | Xia et al. | |
| 5,744,912 | A | 4/1998 | So | |
| 5,751,115 | A | 5/1998 | Jayaraman et al. | |
| 5,751,120 | A | 5/1998 | Zeitler et al. | |
| 5,770,925 | A | 6/1998 | Konopka et al. | |
| 5,770,926 | A | 6/1998 | Choi et al. | |
| 5,777,439 | A | 7/1998 | Hua | |
| 5,783,911 | A | 7/1998 | Rudolph | |
| 5,808,422 | A | 9/1998 | Venkitasubrahmanian et al. | |
| 5,818,669 | A | 10/1998 | Mader | |
| 5,825,136 | A | 10/1998 | Rudolph | |
| 5,844,197 | A | 12/1998 | Daniel | |
| 5,869,935 | A | 2/1999 | Sodhi | |
| 5,872,429 | A | 2/1999 | Xia et al. | |
| 5,883,473 | A | 3/1999 | Li et al. | |
| 5,930,126 | A | 7/1999 | Griffin et al. | |
| 5,932,974 | A | 8/1999 | Wood | |
| 5,939,832 | A | 8/1999 | Franck | |
| 5,945,788 | A | 8/1999 | Li et al. | |
| 6,008,592 | A | 12/1999 | Ribarich | |
| 6,008,593 | A * | 12/1999 | Ribarich | 315/224 |
| 6,177,768 | B1 | 1/2001 | Kamata et al. | |
| 6,184,630 | B1 * | 2/2001 | Qian et al. | 315/224 |
| 6,198,231 | B1 | 3/2001 | Schemmel et al. | |
| 6,222,322 | B1 | 4/2001 | Stack | |
| 6,232,727 | B1 | 5/2001 | Chee et al. | |
| 6,274,987 | B1 | 8/2001 | Burke | |
| 6,292,339 | B1 | 9/2001 | Brooks | |
| 6,400,095 | B1 | 6/2002 | Primisser et al. | |
| 6,429,603 | B1 | 8/2002 | Tsugita et al. | |
| 6,501,225 | B1 | 12/2002 | Konopka | |
| 6,545,432 | B2 | 4/2003 | Konopka | |
| 6,552,501 | B2 | 4/2003 | Ito et al. | |
| 6,646,390 | B2 | 11/2003 | Grabner et al. | |
| 6,696,798 | B2 | 2/2004 | Nishimoto et al. | |
| 6,720,739 | B2 | 4/2004 | Konopka | |
| 6,741,043 | B2 | 5/2004 | Prasad | |
| 6,803,731 | B2 | 10/2004 | Grabner et al. | |
| 6,809,483 | B2 | 10/2004 | Alexandrov | |
| 6,819,063 | B2 | 11/2004 | Nemirow | |
| 7,042,161 | B1 | 5/2006 | Konopka | |
| 7,102,297 | B2 | 9/2006 | Trestman et al. | |
| 7,154,232 | B2 | 12/2006 | Contenti et al. | |
| 7,208,887 | B2 | 4/2007 | Mosebrook et al. | |
| 7,211,966 | B2 | 5/2007 | Green et a | |
| 7,247,998 | B2 | 7/2007 | Poehlman et al. | |
| 7,291,992 | B2 | 11/2007 | Miyazaki | |
| 7,298,099 | B2 | 11/2007 | Ribarich | |
| 7,312,588 | B1 | 12/2007 | Yu et al. | |
| 7,327,101 | B1 | 2/2008 | Chen et al. | |
| 7,368,883 | B2 | 5/2008 | Chan et al. | |
| 2004/0027471 | A1 | 2/2004 | Koseki et al. | |
| 2004/0263089 | A1 * | 12/2004 | Contenti et al. | 315/225 |
| 2005/0046357 | A1 | 3/2005 | Stack | |
| 2007/0029943 | A1 | 2/2007 | Erhardt et al. | |
| 2009/0302772 | A1 * | 12/2009 | Natarelli | 315/200 R |
| 2010/0327763 | A1 * | 12/2010 | Yao et al. | 315/250 |

FOREIGN PATENT DOCUMENTS

| | | |
|---|---|---|
| JP | 4322047 | 11/1992 |
| JP | 5226090 | 9/1993 |
| JP | 5326181 | 12/1993 |
| JP | 11111476 | 4/1999 |
| JP | 2000277290 | 10/2000 |
| JP | 2003059681 | 2/2003 |
| JP | 2004303530 | 10/2004 |
| JP | 2005243305 | 9/2005 |
| JP | 2007188798 | 7/2007 |
| KR | 20050011078 | 1/2005 |
| WO | 2005101921 | 10/2005 |

* cited by examiner

END OF LIFE CONTROL FOR PARALLEL LAMP BALLAST

CROSS-REFERENCES TO RELATED APPLICATIONS

This application claims benefit of the following patent application which is hereby incorporated by reference: U.S. Provisional Patent Application No. 61/561,054, filed Nov. 17, 2011 entitled "END OF LIFE CONTROL FOR PARALLEL LAMP BALLAST".

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to electronic ballasts. More particularly, the present invention pertains to methods and circuits for controlling operating conditions when a lamp of a plurality of lamps connected to ballast in parallel reaches end-of-life.

To meet existing safety standards (e.g., Underwriters Laboratories), fluorescent light fixtures require ballasts having end of lamp life (EOL) protection, especially for T5 or smaller sized lamps. To prevent excessively high voltages, overheating, or other dangerous conditions in the ballast and light fixture, the ballast automatically disconnects each lamp that has reached end-of-life or the ballast shuts down entirely, ceasing power to all lamps in the light fixture.

To cease current flow to a particular lamp that has reached end-of-life (i.e., shut down or disconnect the lamp), ballasts for powering a plurality of lamps connected to the ballast in parallel include an independent switch associated with each lamp. When the ballast detects an end-of-life condition in a lamp, the associated switch is opened to prevent current flow to the lamp and excessive voltage at the connection of the lamp to the light fixture. Switches for use in this application, such as high voltage bipolar junction transistors and high voltage MOSFETs, are particularly expensive, and if the switch fails, the end-of-life protection scheme in some ballast designs may also fail.

BRIEF SUMMARY OF THE INVENTION

In one aspect of the present invention, a ballast providing an output signal to a plurality of lamps connected to the ballast in parallel includes an output circuit, an end-of-life monitor, and a controller. The output circuit provides an output signal to the plurality of lamps connected to the ballast as a function of a control signal. The end-of-life monitor provides a signal indicative of an end-of-life condition of a lamp of the plurality of lamps. The controller is operably connected to the output circuit and the end-of-life monitor. The controller generates the control signal as a function of a first steady state condition, and the control signal determines a frequency of the output signal. The controller senses an end-of-life condition in a lamp of the plurality of lamps as a function of the signal indicative of an end-of-life condition from the end-of-life monitor. In response to sensing the end-of-life condition in the lamp, the controller increases the frequency until current ceases to flow through the lamp. In response to current ceasing to flow through the lamp, the controller provides the control signal as a function of a second steady state condition, and the second steady state condition is different from the first steady state condition.

In another aspect, a method of operating a ballast having a plurality of lamps connected to the ballast in parallel includes providing an output signal to the plurality of lamps connected to the ballast in parallel as a function of a first steady state condition. An end-of-life condition is sensed in a lamp of the plurality of lamps. In response to sensing the end-of-life condition in the lamp, the frequency of the output signal is increased until current ceases to flow through the lamp. In response to current ceasing to flow through the lamp, the output signal is provided as a function of a second steady state condition, and the second steady state condition is different from the first steady state condition.

A light fixture according to the present invention includes a ballast and a housing. The ballast provides an output signal to a plurality of lamps connected to the ballast in parallel and includes an output circuit, an end-of-life monitor, and a controller. The output circuit provides an output signal to the plurality of lamps connected to the ballast as a function of a control signal. The end-of-life monitor provides a signal indicative of an end-of-life condition of a lamp of the plurality of lamps. The controller is operably connected to the output circuit and the end-of-life monitor. The controller generates the control signal as a function of a first steady state condition, and the control signal determines a frequency of the output signal. The controller senses an end-of-life condition in a lamp of the plurality of lamps as a function of the signal indicative of an end-of-life condition from the end-of-life monitor. In response to sensing the end-of-life condition in the lamp, the controller increases the frequency until current ceases to flow through the lamp. In response to current ceasing to flow through the lamp, the controller provides the control signal as a function of a second steady state condition, and the second steady state condition is different from the first steady state condition. The housing is affixed to the ballast, and the housing receives the plurality of lamps.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
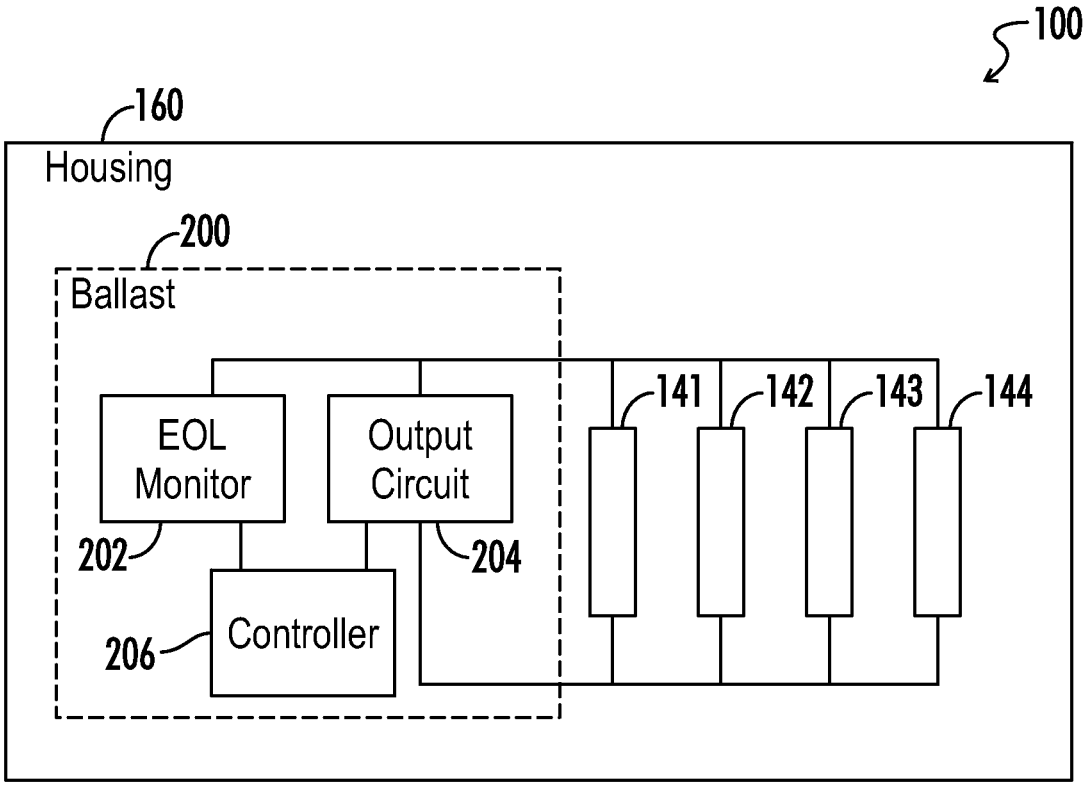
FIG. 1 is a block diagram of a light fixture for providing power to a plurality of lamps connected in parallel to a ballast of the light fixture, according to one embodiment of the invention.

Referring to FIG. 1, a light fixture 100 includes a ballast 200, a housing 160, and a plurality of lamps installed in the housing 160. The lamps are electrically connected to the ballast 200 in parallel (i.e., a first lamp 141, a second lamp 142, a third lamp 143, and a fourth lamp 144). The ballast 200 includes an output circuit 204, an end-of-life monitor 202, and a controller 206.

The end-of-life monitor 202 provides a signal indicative of an end-of-life condition of a lamp of the plurality of lamps to the controller 206. It is contemplated that the end-of-life monitor 202 may be embodied by any number or type of circuit for detecting an end-of-life condition. The end-of-life monitor 202 and controller 206 may cooperate to determine an end-of-life condition based on total current through the plurality of lamps, or based on individual voltages and/or currents associated with each lamp of the plurality of lamps. In one embodiment, the end-of-life monitor 202 may include an impedance in series with the plurality of lamps, such that the end-of-life monitor 202 provides a signal indicative of the total current through the plurality of lamps. In one embodiment, the end-of-life monitor 202 may include a plurality of impedances, each in series with an associated lamp of the plurality of lamps, such that the end-of-life monitor 202 provides signals to the controller 206 indicative of a current and/or voltage associated with each lamp. An end-of-life condition may also be sensed by determining that a current through a lamp is less than a current through another lamp.

The output circuit 204 provides an output signal to the plurality of lamps connected to an output of the ballast 200. A control signal generated by the controller 206 determines a frequency of the output signal, and the control signal is generated by the controller 206 as a function of a first steady state condition. In one embodiment, the first steady state condition is a first total current equal to a total of a target current through each of the plurality of lamps. The controller 206 senses an end-of-life condition and a lamp (e.g., the first lamp 141) of the plurality of lamps as a function of the signal indicative of the end-of-life condition from the end-of-life monitor 202. In response to sensing the end-of-life condition and the lamp, the controller 206 increases the frequency of the output signal until current ceases to flow through the lamp exhibiting the end-of-life condition. The ballast 200 continuously provides current to the other lamps of the plurality of lamps while increasing the frequency of the output signal such that only the lamp exhibiting the end-of-life condition ceases to conduct current and emit light.

In one embodiment, the controller 206 determines that current has ceased to flow through the lamp exhibiting the end-of-life condition by determining a reduction in a total current through the plurality of lamps. In another embodiment, the controller 206 determines that current has ceased to flow through the lamp exhibiting the end-of-life condition by determining that a current through that lamp is substantially zero. In response to current ceasing flow through the lamp, the controller 206 provides the control signal to the output circuit 204 as a function of a second steady-state condition. In one embodiment, the second steady-state condition is a second total current equal to a total of the target currents through each of the plurality of lamps for which an end-of-life condition has not been sensed by the controller 206. Thus, the second total current is less than the first total current and proportional to the first total current. An end-of-life condition may be sensed by determining that one or all of the lamps of the plurality of lamps is a negative asymmetric load, determining that one or all of the lamps of the plurality of lamps is a positive asymmetric load, determining that an impedance of a lamp exceeds a predetermined threshold impedance, determining that a current through a lamp is less than a predetermined threshold current, and/or determining that a total current through the plurality of lamps is less than a predetermined threshold current.

Figure 2:
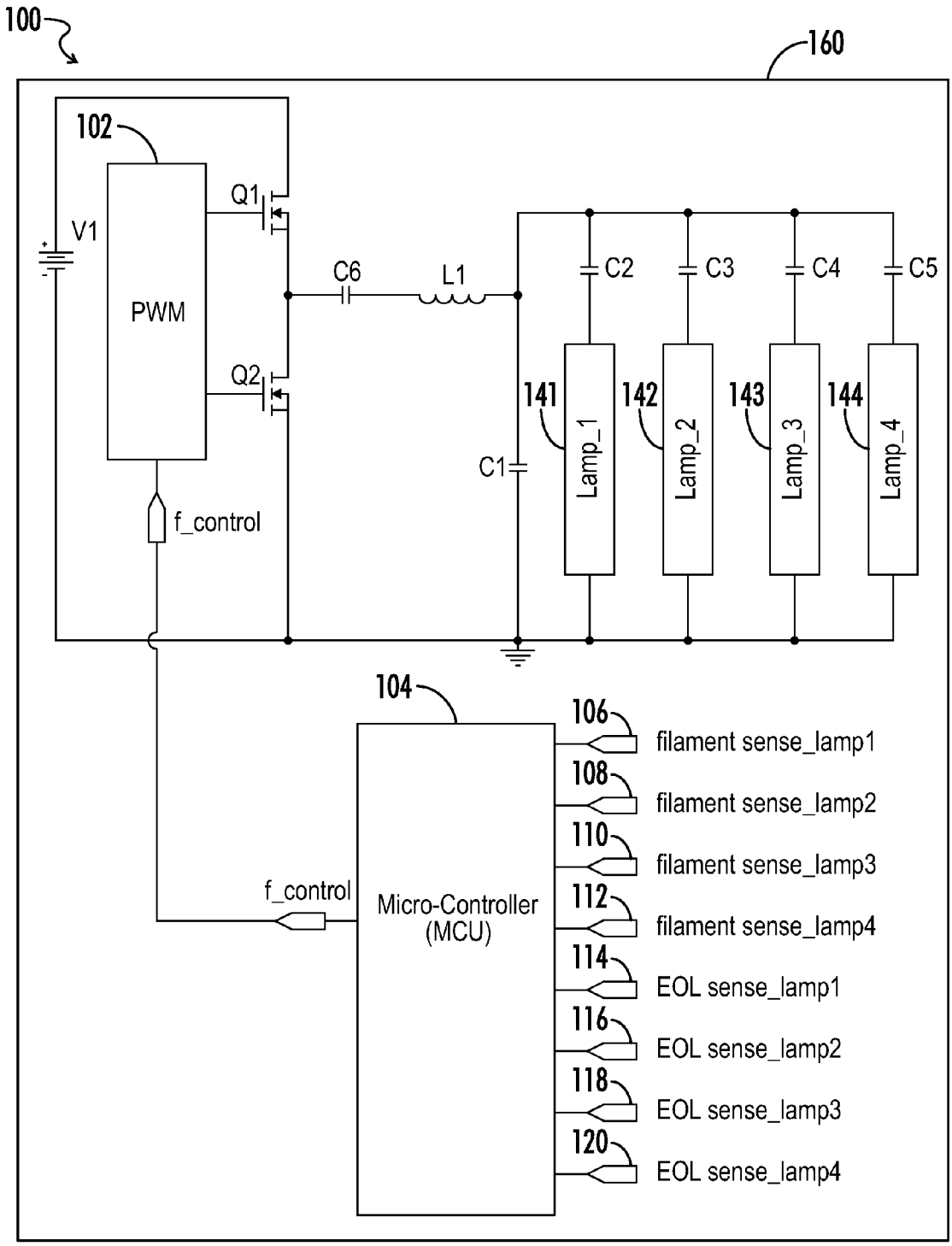
FIG. 2 is a block diagram of a light fixture and partial schematic of a ballast and plurality of lights of the light fixture operating in a steady state condition, according to an embodiment of the invention.

Referring to FIG. 2, one embodiment of the ballast 200 of FIG. 1 is shown in partial schematic. The output circuit 204 of the ballast 200 includes a power source shown as voltage source V1, an inverter shown as a half-bridge inverter including a first switch Q1 and a second switch Q2, and a resonant tank connected to the output of the half-bridge inverter (i.e., the junction between first and second switches Q1 and Q2) including an inductor L1 and a capacitor C1. The controller 206 is shown as pulse width modulator 102 and microcontroller 104. It is contemplated that the pulse width modulator 102 and microcontroller 104 may be integral on a single microchip, or the functions may be split between two or more microchips.

The end-of-life monitor 202 is shown as sensing inputs of the microcontroller 104, including first lamp filament sense 106, second lamp filament sense 108, third lamp filament sense 110, fourth lamp filament sense 112, first lamp end-of-life sense 114, second lamp end-of-life sense 116, third lamp end-of-life sense 118, and fourth lamp end-of-life sense 120. In the embodiment of FIG. 2, a current limiting capacitor is connected in series with each lamp. Capacitor C2 is connected in series with the first lamp 141, capacitor C3 is connected in series with the second lamp 142, capacitor C4 is connected in series with the third lamp 143, and capacitor C5 is connected in series with the fourth lamp 144. It is contemplated that the end-of-life monitor 202 may sense a voltage across the current limiting capacitor associated with each lamp or include another impedance associated with each lamp to sense an end-of-life condition of the associated lamp. It is also contemplated that the end-of-life monitor 202 may instead or additionally monitor a total current through all of the lamps to determine an end-of-life condition of a lamp. A direct current (DC) blocking capacitor C6 prevents DC current from flowing from the output of the inverter through the inductor L1 of the resonant tank.

The inverter (i.e., the first switch Q1 and the second switch Q2) receives a drive signal generated by the controller 206 and power from the power supply V1, and outputs an AC drive signal at the output of the inverter (i.e., the junction between the first switch Q1 and the second switch Q2). The resonant tank (i.e., the inductor L1 and the capacitor C1) receives the AC signal from the output of the inverter and provides the output signal to the plurality of lamps (i.e., first lamp 141, the second lamp 142, the third lamp 143, in the fourth lamp 144). The capacitor C1 is connected in parallel with the plurality of lamps. A low side of the capacitor C1 is connected to a ground of the ballast 200, and a high side of the capacitor C1 is connected to a first terminal of the inductor L1. A second terminal of the inductor L1 is connected to the output of the inverter via DC blocking capacitor C6.

In operation, the microcontroller 104 operates the pulse width modulator 102 in a 1st steady-state condition. When the microcontroller 104 detects an end-of-life condition in one of the lamps, the microcontroller 104 provides a control signal to the pulse width modulator 102 to increase the frequency of the output signal from the ballast 200 to the plurality of lamps connected to the ballast 200 in parallel. The lamp impedance increases as current through the lamp reduces. The lamp exhibiting the end-of-life condition has a higher impedance than the other lamps of the plurality of lamps such that as the total current through the plurality of lamps decreases, the current through the lamp exhibiting the end-of-life condition decreases faster than the current through the other lamps of the plurality of lamps. When the total current to the plurality of lamps is sufficiently reduced, the voltage across the capacitor C1, and therefore the lamps, is not large enough to sustain the arc since the impedance of the lamp exhibiting the end-of-life condition is larger than the impedance of the other lamps. The ballast 200 can thus shut down each and every lamp exhibiting an end-of-life condition while continuously providing current to the lamps of the plurality of lamps, which are not exhibiting an end-of-life condition.

Figure 3:
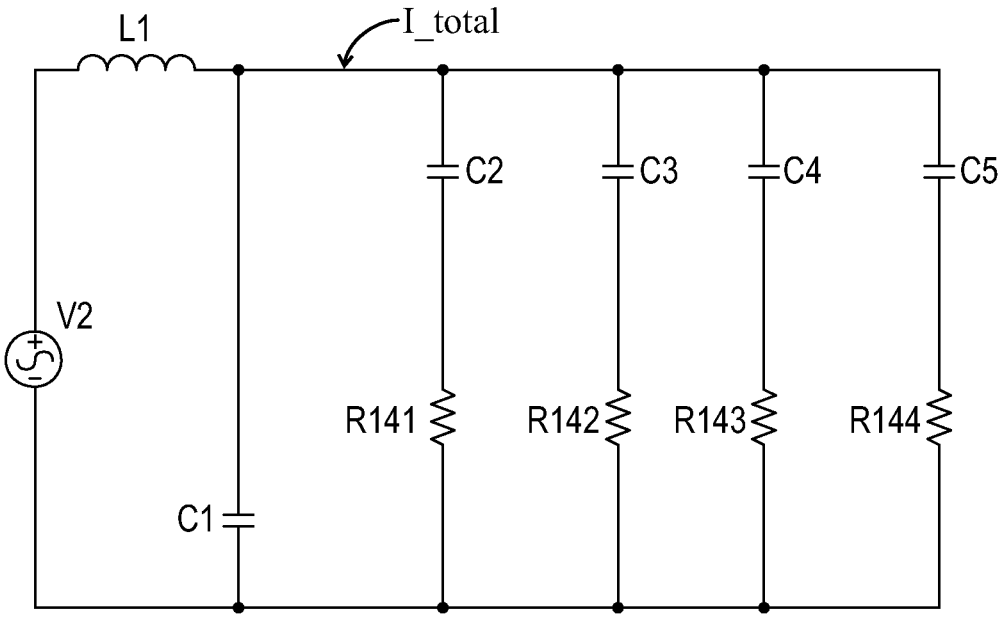
FIG. 3 is a schematic of an equivalent circuit of the ballast and plurality of lamps of FIG. 2 operating in a steady state condition.

Referring to FIG. 3, an equivalent circuit for the ballast 200 and lamps 141, 142, 143, and 144 shows the load presented by the plurality of lamps to the ballast 200 when none of the plurality of lamps is exhibiting an end-of-life condition. The ballast 200 and plurality of lamps are operating in a first steady state condition. A total current through the plurality of lamps is approximately equal to a total of a target current through each lamp, and each lamp of the plurality of lamps has a current that is approximately equal to a current of each of the other lamps. A signal generator V2 represents the AC signal output by the inverter. Each lamp of the plurality of lamps is represented as a resistor. The first lamp 141 is represented as a first resistor R141, the second lamp 142 is represented as a second resistor R142, the third lamp 143 is represented as a third resistor R143, and the fourth lamp 144 is represented as a fourth resistor R144.

Figure 4:
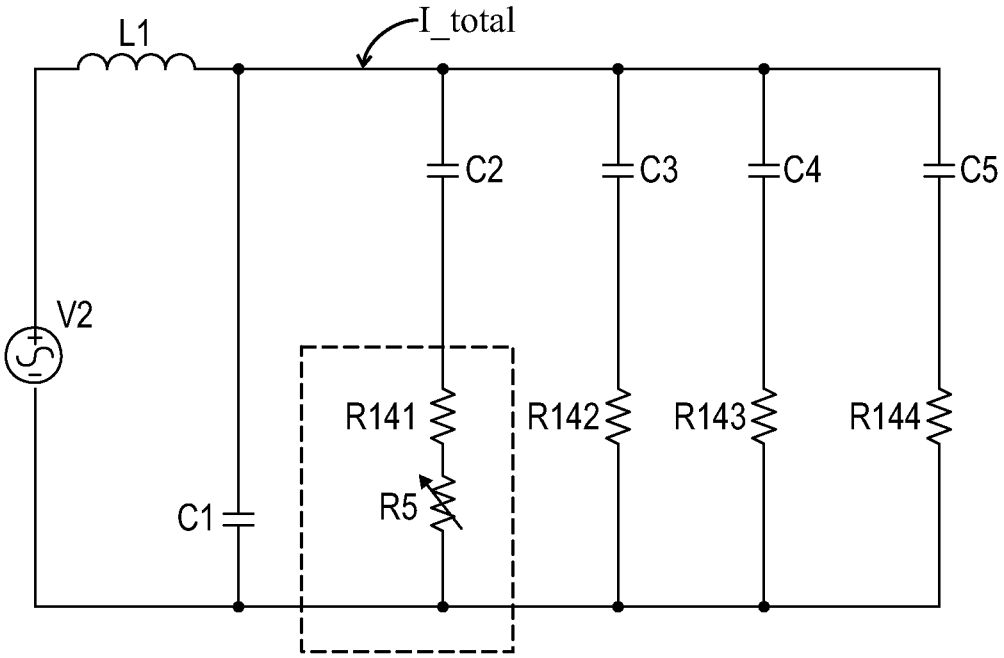
FIG. 4 is a schematic of an equivalent circuit of the ballast and plurality of lamps of FIG. 2 with one of the lamps having a symmetric end-of-life condition.

Referring to FIG. 4, an equivalent circuit for the ballast 200 and lamps 141, 142, 143, and 144 shows the load presented by the plurality of lamps to the ballast 200 when the first lamp 141 is exhibiting a symmetric end-of-life condition. A variable resistance R5 is connected in series with the first resistor R141 and first current limiting capacitor C2 to the output of the ballast 200. The end-of-life monitor 202 can detect this symmetric end-of-life condition in the first lamp 141 by, for example, detecting a decrease in the total current through the plurality of lamps, detecting a decrease in the current through the first lamp 141, or detecting an increase in a voltage across the first lamp 141.

Figure 5:
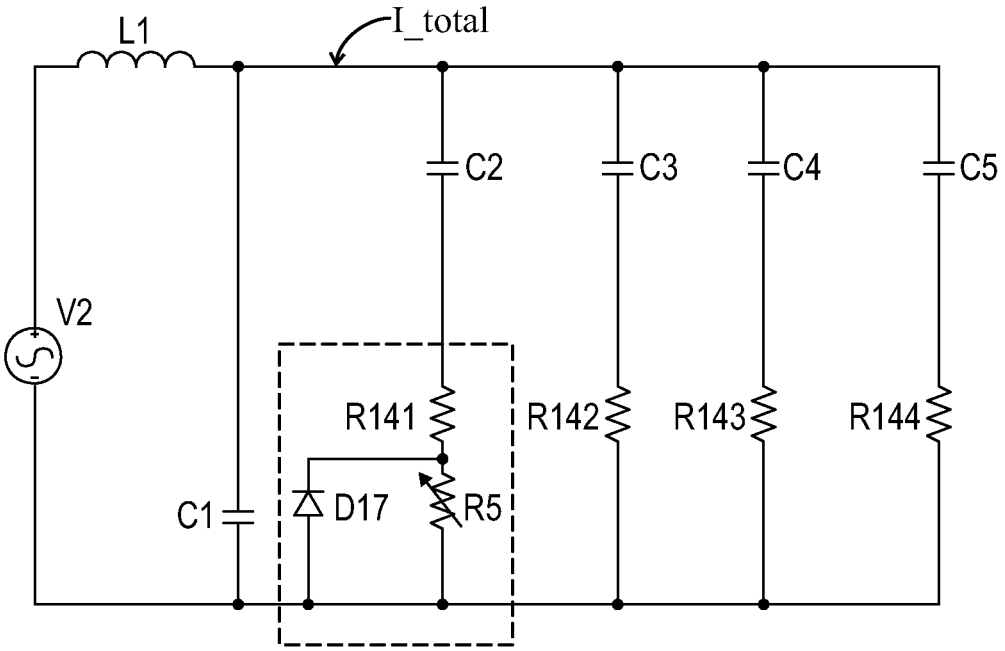
FIG. 5 is a schematic of an equivalent circuit of the ballast and plurality of lamps of FIG. 2 with one of the lamps having a positive asymmetric end-of-life condition.

Referring to FIG. 5, an equivalent circuit for the ballast 200 and lamps 141, 142, 143, and 144 shows the load presented by the plurality of lamps to the ballast 200 when the first lamp 141 is exhibiting a positive asymmetric end-of-life condition. The first lamp 141 is represented by the first resistance R141, the variable resistance R5, and a first diode D17. The variable resistance R5 is connected in series with the first resistor R141 and first current limiting capacitor C2 to the output of the ballast 200. In addition, the first diode D17 is connected in parallel with the variable resistance R5. An anode of the first diode D17 is connected to a ground of the ballast 200, and a cathode of the first diode D17 is connected to a junction between the first resistance R141 and the variable resistor R5. The end-of-life monitor 202 can detect this positive asymmetric end-of-life condition in the first lamp 141 by, for example, detecting asymmetric current flow through the first lamp 141, detecting a decrease in the total current through the plurality of lamps, or detecting an increase in a voltage across the first lamp 141.

Figure 6:
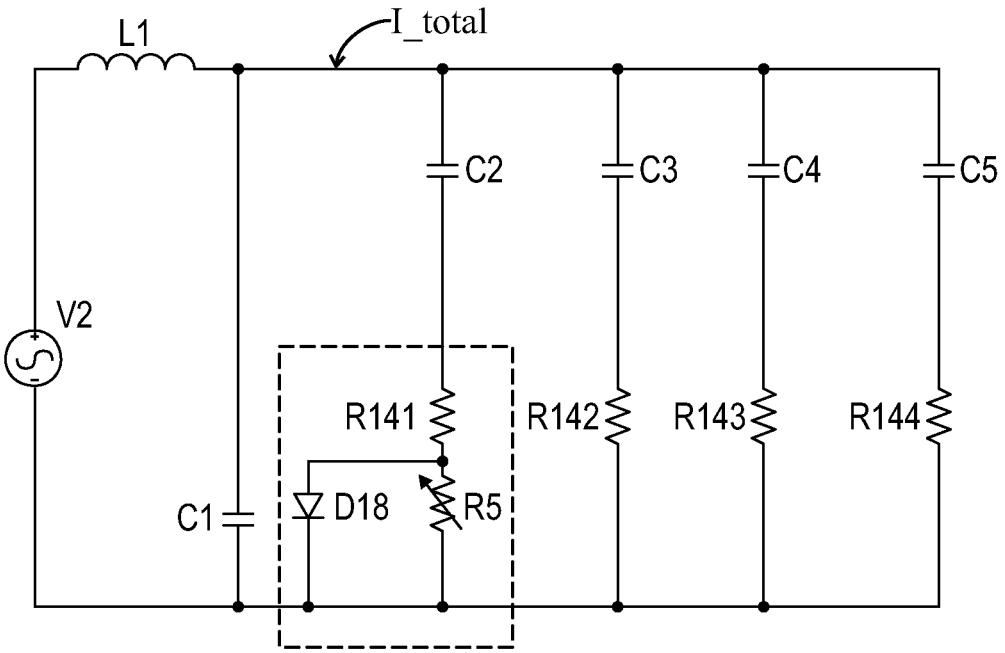
FIG. 6 is a schematic of an equivalent circuit of the ballast and plurality of lamps of FIG. 2 with one of the lamps having a negative asymmetric end-of-life condition.

Referring to FIG. 6, an equivalent circuit for the ballast 200 and lamps 141, 142, 143, and 144 shows the load presented by the plurality of lamps to the ballast 200 when the first lamp 141 is exhibiting a negative asymmetric end-of-life condition. The first lamp 141 is represented by the first resistance R141, the variable resistance R5, and a second diode D18. The variable resistance R5 is connected in series with the first resistor R141 and first current limiting capacitor C2 to the output of the ballast 200. In addition, the second diode D18 is connected in parallel with the variable resistance R5. A cathode of the second diode D18 is connected to a ground of the ballast 200, and an anode of the first diode D18 is connected to a junction between the first resistance R141 and the variable resistor R5. The end-of-life monitor 202 can detect this negative asymmetric end-of-life condition in the first lamp 141 by, for example, detecting asymmetric current flow through the first lamp 141, detecting a decrease in the total current through the plurality of lamps, or detecting an increase in a voltage across the first lamp 141.

Figure 7:
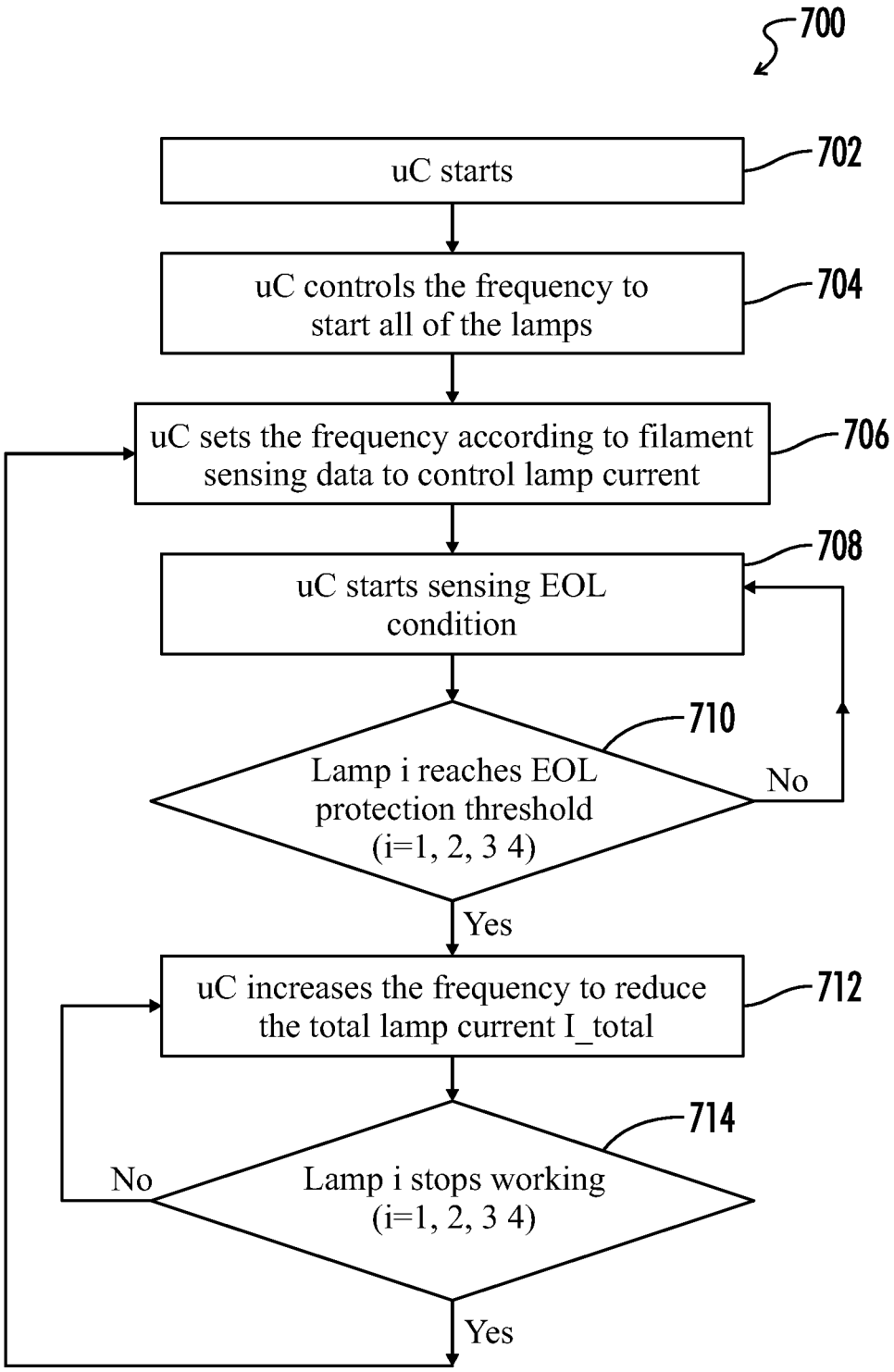
FIG. 7 is a flow chart of a method of starting up and operating the ballast of FIG. 2 when one or more of the plurality of lamps exhibits an end-of-life condition.

Referring to FIG. 7, a method 700 of operating the ballast 200 (see FIG. 2) having a plurality of lamps connected in parallel to the ballast 200 begins at 702, when the microcontroller 104 starts the ballast 200. At 704, the microcontroller 104 sweeps the frequency of the pulse width modulator 102 to start all of the lamps. At 706, the microcontroller 104 sets a frequency of the pulse width modulator 102 according to filament sensing data. The filament sensing data indicates a quantity of lamps of the plurality of lamps that are operating properly. The frequency is determined as a function of the quantity of lamps of the plurality of lamps that are operating properly (i.e., not exhibiting an end-of-life condition) and a target current for each lamp of the plurality of lamps. At 708, the microcontroller 104 senses the beginning of an end-of-life condition for at least one lamp of the plurality of lamps. At 710, microcontroller 104 determines whether the end-of-life condition has reached a predetermined protection threshold. If not, the method returns to 708, and if so at 712, the microcontroller 104 increases the frequency of the pulse width modulator 102 to reduce the total current through the plurality of lamps. At 714, the microcontroller 104 determines whether the lamp exhibiting the end-of-life condition has stopped working (i.e., current has ceased to flow through the lamp exhibiting the end-of-life condition). If not, the method returns to 712, and if so, the microcontroller 104 sets the frequency of the pulse width modulator 102 according to the filament sensing data such that the ballast 200 operates at a second steady-state condition. In one embodiment, the second steady state condition is a total current through the plurality of lamps equal to the product of the quantity of lamps of the plurality of lamps that are operating properly and a target current for each lamp of the plurality of lamps.

Figure 8:
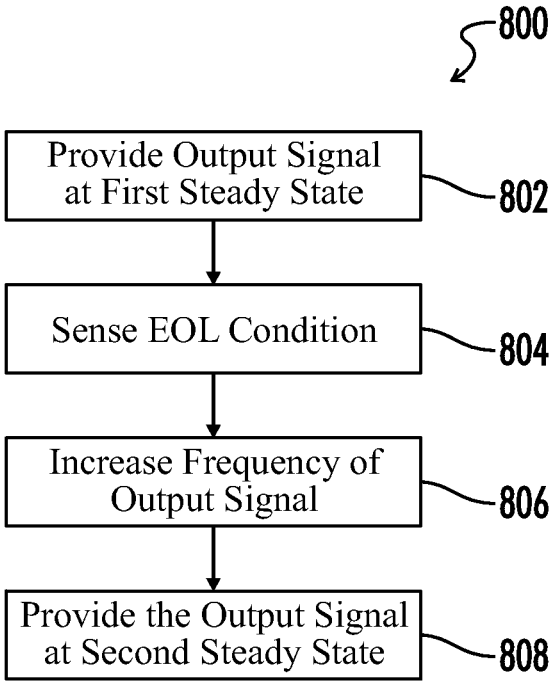
FIG. 8 is a flow chart of a method of operating a ballast having a plurality of lamps connected to the ballast in parallel when one or more of the plurality of lamps exhibits an end-of-life condition.

Referring to FIG. 8, a method 800 of operating a ballast having a plurality of lamps connected to the ballast in parallel when one or more of the plurality of lamps exhibits an end-of-life condition begins at 802. At 802, the ballast provides an output signal to the plurality of lamps as a function of a first steady-state condition. At 804, the ballast senses an end-of-life condition and a lamp of the plurality of lamps. In response to sensing the end-of-life condition and the lamp, the ballast increases a frequency of the output signal until current ceases to flow through the lamp exhibiting the end-of-life condition at 806. In response to current ceasing to flow through the lamp, at 808, the ballast provides the output signal as a function of a second steady-state condition different from the first steady-state condition. The ballast continuously provides current to the lamps not exhibiting an end-of-life condition when increasing the frequency of the output signal in response to sensing the end-of-life condition in the lamp.

In one embodiment, the first steady-state condition is a first total current determined as a function of a first quantity of lamps in the plurality of lamps connected to the ballast in parallel for which an end-of-life condition is not incensed, and the second steady-state condition is a second total current determined as a function of a second quantity of lamps in the plurality of lamps for which an end-of-life condition has not been sensed. The first quantity is greater than the second quantity such that the second total current is less than the first total current, and a frequency associated with the second steady-state condition is less than a frequency associated with the first steady-state condition.

It is contemplated that sensing the end-of-life condition at 804 may be accomplished by monitoring any number of end-of-life indicators. The end-of-life condition may be sensed at 804 by: determining that current through a lamp is less than a current through another lamp of the plurality of lamps; determining that the plurality of lamps presents a negative asymmetric load; determining that the plurality of lamps presents a positive asymmetric load; determining that an impedance of a lamp exceeds a predetermined threshold impedance; determining that a current through a lamp is less than a predetermined threshold current; and/or determining that a total current through the lamps is less than a predetermined threshold. It is also contemplated that sensing the end-of-life condition 804 may be accomplished by a combination of the aforementioned sensing methods.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, computing device, or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

What is claimed is:

1. A ballast operable to provide an output signal to a plurality of lamps connected to the ballast in parallel, said ballast comprising:

an output circuit operable to provide an output signal to the plurality of lamps connected to an output of the ballast as a function of a control signal;

an end-of-life monitor operable to provide a signal indicative of an end-of-life condition of a lamp of the plurality of lamps;

a controller operably connected to the output circuit and the end-of-life monitor, said controller functional to:

generate the control signal as a function of a first steady state condition, wherein the control signal determines a frequency of the output signal;

sense an end-of-life condition in a lamp of the plurality of lamps as a function of the signal indicative of an end-of-life condition from the end-of-life monitor;

in response to sensing the end-of-life condition in the lamp, increase the frequency of the output signal until current ceases to flow through the lamp; and in response to current ceasing to flow through the lamp, providing the control signal as a function of a second steady state condition, wherein the second steady state condition is different from the first steady state condition, and the second steady state condition has a current greater than zero.

2. The ballast of claim 1 wherein the output circuit comprises:

an inverter operable to receive the control signal generated by the controller, receive power from a power supply of the ballast and output a drive signal at an output of the inverter;

a resonant tank effective to receive the drive signal from the output of the inverter and provide the output signal to the plurality of lamps, wherein the resonant tank comprises a resonant capacitor coupled in parallel with the plurality of lamps, a direct current blocking capacitor coupled to the output of the inverter, and a resonant inductor connected between the direct current blocking capacitor and a high side of the resonant capacitor; and a plurality of current limiting capacitors, each of the plurality of current limiting capacitors coupled between the high side of the resonant capacitor and an associated lamp of the plurality of lamps.

3. The ballast of claim 1 wherein the end-of-life monitor comprises an impedance element in series with the plurality of lamps and effective to provide a signal indicative of a total current through the plurality of lamps.

4. The ballast of claim 1 wherein the end-of-life monitor comprises a plurality of impedance elements, each impedance element in series with an associated lamp of the plurality of lamps, each impedance element effective to provide a signal indicative of a current through the associated lamp.

5. The ballast of claim 1 wherein the end-of-life monitor comprises a voltage monitor operable to detect a voltage across each lamp of the plurality of lamps.

6. The ballast of claim 1 wherein the ballast is operable to continuously provide current to the other lamps of the plurality of lamps when increasing the frequency of the output signal in response to sensing the end-of-life condition in the lamp.

7. The ballast of claim 1, wherein:

the first steady state condition is a first total current and the controller is operable to determine the first total current as a function of a first quantity of lamps in the plurality of lamps connected to the ballast in parallel for which an end-of-life condition has not been sensed;

the second steady state condition is a second total current and the controller is operable to determine the second total current as a function of a second quantity of lamps in the plurality of lamps connected to the ballast in parallel for which an end-of-life condition has not been sensed;

the first quantity of lamps is greater than the second quantity of lamps; and the second total current is proportional to the first total current.

8. The ballast of claim 1 wherein the controller is operable to sense the end-of-life condition by determining that current through the lamp is less than a current through another lamp of the plurality of lamps.

9. The ballast of claim 1 wherein the controller is operable to sense the end-of-life condition by at least one of:

determining that the plurality of lamps is a negative asymmetric load;

determining that the plurality of lamps is a positive asymmetric load;

determining that an impedance of the lamp exceeds a predetermined threshold impedance; or determining that a current through the lamp is less than a predetermined threshold current.

10. The ballast of claim 1 wherein:

the controller is operable to sense the end-of-life condition by determining that a total current through the lamps is less than a predetermined threshold; and the controller is operable to determine that current has ceased to flow through the lamp by determining a reduction in a total current through the plurality of lamps.

11. A method of operating a ballast having a plurality of lamps connected to the ballast in parallel, said method comprising:

providing an output signal to the plurality of lamps connected to the ballast in parallel as a function of a first steady state condition;

sensing an end-of-life condition in a lamp of the plurality of lamps;

in response to sensing the end-of-life condition in the lamp, increasing a frequency of the output signal until current ceases to flow through the lamp; and in response to current ceasing to flow through the lamp, providing the output signal as a function of a second steady state condition, wherein the second steady state condition is different from the first steady state condition, and the second steady state condition has a current greater than zero.

12. The method of claim 11 wherein current is continuously provided to the other lamps of the plurality of lamps when increasing the frequency of the output signal in response to sensing the end-of-life condition in the lamp.

13. The method of claim 11 wherein providing the output signal as a function of a second steady state condition comprises decreasing the frequency of the output signal.

14. The method of claim 11 wherein:

the first steady state condition is a first total current determined as a function of a first quantity of lamps in the plurality of lamps connected to the ballast in parallel for which an end-of-life condition has not been sensed;

the second steady state condition is a second total current determined as a function of a second quantity of lamps in the plurality of lamps connected to the ballast in parallel for which an end-of-life condition has not been sensed;

the first quantity of lamps is greater than the second quantity of lamps; and the second total current is proportional to the first total current.

15. The method of claim 11 wherein sensing the end-of-life condition comprises determining that current through the lamp is less than a current through another lamp of the plurality of lamps.

16. The method of claim 11 wherein sensing the end-of-life condition comprises at least one of:

determining that the plurality of lamps is a negative asymmetric load;

determining that the plurality of lamps is a positive asymmetric load;

determining that an impedance of the lamp exceeds a predetermined threshold impedance; or determining that a current through the lamp is less than a predetermined threshold current.

17. The method of claim 11 wherein:

sensing the end-of-life condition comprises determining that a total current through the lamps is less than a predetermined threshold; and current ceasing to flow through the lamp is determined from a reduction in a total current through the plurality of lamps.

18. A light fixture comprising:

a ballast operable to provide an output signal to a plurality of lamps connected to the ballast in parallel, said ballast comprising:

an output circuit operable to provide an output signal to the plurality of ballasts connected to an output of the ballast as a function of a control signal;

an end-of-life monitor operable to provide a signal indicative of an end-of-life condition of a lamp of the plurality of lamps;

a controller operably connected to the output circuit and the end-of-life monitor, said controller operable to generate the control signal as a function of a first steady state condition, wherein the control signal determines a frequency of the output signal, sense an end-of-life condition in a lamp of the plurality of lamps as a function of the signal indicative of an end-of-life condition from the end-of-life monitor, in response to sensing the end-of-life condition in the lamp, increase the frequency until current ceases to flow through the lamp, and in response to current ceasing to flow through the lamp, providing the control signal as a function of a second steady state condition, wherein the second steady state condition is different from the first steady state condition, and the second steady state condition has a current greater than zero; and a housing affixed to the ballast, said housing configured to receive the plurality of lamps.

19. The light fixture of claim 18 further comprising a plurality of lamps, wherein each of the plurality of lamps is installed in the housing.

20. The light fixture of claim 18 wherein the output circuit comprises:

an inverter operable to receive the control signal generated by the controller, receive power from a power supply of the ballast and output a drive signal at an output of the inverter;

a resonant tank operable to receive the drive signal from the output of the inverter and provide the output signal to the plurality of lamps, wherein the resonant tank comprises a resonant capacitor connected in parallel with the plurality of lamps, a direct current blocking capacitor connected to the output of the inverter, and a resonant inductor connected between the direct current blocking capacitor and a high side of the resonant capacitor; and a plurality of current limiting capacitors, each of the plurality of current limiting capacitors connected between the high side of the resonant capacitor and an associated lamp of the plurality of lamps.

21. The light fixture of claim 18 wherein the end-of-life monitor comprises an impedance element in series with the plurality of lamps operable to provide a signal indicative of a total current through the plurality of lamps.

22. The light fixture of claim 18 wherein the end-of-life monitor comprises a plurality of impedance elements, each impedance element in series with an associated lamp of the plurality of lamps, each impedance operable to provide a signal indicative of a current through the associated lamp.

23. The light fixture of claim 18 wherein the end-of-life monitor comprises a voltage monitor operable to detect a voltage across each lamp of the plurality of lamps.

24. The light fixture of claim 18 wherein the ballast is operable to continuously provide current to the other lamps of the plurality of lamps when increasing the frequency of the output signal in response to sensing the end-of-life condition in the lamp.

25. The light fixture of claim 18, wherein:

the first steady state condition is a first total current and the controller is operable to determine the first total current as a function of a first quantity of lamps in the plurality of lamps connected to the ballast in parallel for which an end-of-life condition has not been sensed;

the second steady state condition is a second total current and the controller is operable to determine the second total current as a function of a second quantity of lamps in the plurality of lamps connected to the ballast in parallel for which an end-of-life condition has not been sensed;

the first quantity of lamps is greater than the second quantity of lamps; and the second total current is proportional to the first total current.

26. The light fixture of claim 18 wherein the controller is operable to sense the end-of-life condition by determining that current through the lamp is less than a current through another lamp of the plurality of lamps.

27. The light fixture of claim 18 wherein the controller is operable to sense the end-of-life condition by at least one of:

determining that the plurality of lamps is a negative asymmetric load;

determining that the plurality of lamps is a positive asymmetric load;

determining that an impedance of the lamp exceeds a predetermined threshold impedance; or determining that a current through the lamp is less than a predetermined threshold current.

28. The light fixture of claim 18 wherein:

the controller is operable to sense the end-of-life condition by determining that a total current through the lamps is less than a predetermined threshold; and the controller is operable to determine that current has ceased to flow through the lamp by determining a reduction in a total current through the plurality of lamps.

* * * * *